US006367551B1

(12) United States Patent
Fenton

(10) Patent No.: US 6,367,551 B1
(45) Date of Patent: Apr. 9, 2002

(54) MONOBORE RISER

(75) Inventor: Stephen Paul Fenton, Inverurie (GB)

(73) Assignee: ABB Vetco Gray Incorporated, Houston, TX (US)

( * ) Notice: Subject to any disclaimer, the term of this patent is extended or adjusted under 35 U.S.C. 154(b) by 0 days.

(21) Appl. No.: 09/465,630

(22) Filed: Dec. 17, 1999

Related U.S. Application Data

(60) Provisional application No. 60/112,879, filed on Dec. 18, 1998.

(51) Int. Cl.[7] ..... E21B 33/038

(52) U.S. Cl. ..... 166/345; 166/348; 166/368

(58) Field of Search ..... 166/345, 348, 166/368, 339

(56) References Cited

U.S. PATENT DOCUMENTS

| | | | | |
|---|---|---|---|---|
| 3,850,237 A | | 11/1974 | Ahlstone et al. | |
| 4,160,478 A | | 7/1979 | Calhoun et al. | |
| 4,754,813 A | | 7/1988 | Jennings et al. | 166/344 |
| 4,852,611 A | | 8/1989 | Knerr et al. | 137/595 |
| 4,958,686 A | | 9/1990 | Putch | |
| 5,143,158 A | | 9/1992 | Watkins et al. | |
| 5,575,336 A | * | 11/1996 | Morgan | 166/330 |
| 5,868,204 A | * | 2/1999 | Pritchett et al. | 166/368 |
| 5,988,282 A | * | 11/1999 | Jennings et al. | 166/348 |
| 6,053,252 A | * | 4/2000 | Edwards | 166/348 |

FOREIGN PATENT DOCUMENTS

| | | | |
|---|---|---|---|
| GB | 2346630 A | * | 8/2000 |
| WO | WO 86/01852 | | 3/1986 |

* cited by examiner

*Primary Examiner*—David Bagnell
*Assistant Examiner*—Zakiya Walker
(74) *Attorney, Agent, or Firm*—Bracewell & Patterson, L.L.P.

(57) ABSTRACT

A subsea well uses a shuttle valve for connecting tubing annulus passageways between a riser and a tree of a subsea well. The riser has a connector that lands on an upper end of a tree. The riser connector has a production passage and an annulus port. An internal tree cap is located within the tree. A production passage passes through the internal tree cap and an annulus passage communicates with a top surface of the internal tree cap and the annulus passage of the tree. The shuttle valve is located within a valve receptacle or valve cylinder in an upper end of the annulus passage. A portion of the shuttle valve extends above the upper surface of the internal tree cap so that the shuttle valve opens when the riser connector lands on the top of the internal tree cap. Alternatively, the shuttle valve may be hydraulically actuated.

24 Claims, 3 Drawing Sheets

MONOBORE RISER

CROSS-REFERENCE TO RELATED APPLICATIONS

This application claims the benefits of provisional application Ser. No. 60/112,879, filed on Dec. 18, 1998, in the U.S. Patent and Trademark Office.

TECHNICAL FIELD

This invention relates in general to a riser and in particular to an adapted version of a shuttle valve for connecting passageways between a riser and a tree in a subsea well.

BACKGROUND OF THE INVENTION

A conventional subsea wellhead assembly includes a wellhead housing which supports one or more casing hangers located at upper ends of strings of casing extending into the well. A tubing hanger lands in the wellhead housing above the casing hanger and supports a string of production tubing that extends through the smallest diameter casing. The tubing hanger has a production bore which is offset slightly from the longitudinal axis. An annulus bore also extends through the tubing hanger, parallel to and offset from the axis, for communicating the tubing annulus to above the tubing hanger. The annulus bore is needed during installation of the tubing hanger and tubing to establish circulation down the tubing and back up the annulus. After the well has been completed, a removable plug is installed in the annulus bore, then a production tree is mounted to the wellhead housing. Access through the production tree to the tubing may be made for various workover operations that are needed.

Operators have begun installing a different type of wellhead assembly, referred to generally as a horizontal tree. In a horizontal tree, the tubing hanger lands in the tree, not in the wellhead housing located below the tree. The tubing hanger has a laterally extending production passage that registers with a passage in the tree. A bypass passage for tubing annulus access extends around the tubing hanger.

Various proposals have been made concerning workover operations on horizontal trees. Generally, the proposals suggest installing a monobore riser on the horizontal tree head. An annulus circulation line that is either separate or integrated with the monobore riser extends to the surface. The annulus circulation line communicates with an annulus circulation port in the horizontal tree above the tubing hanger.

SUMMARY OF THE INVENTION

A subsea test tree or riser connector is affixed on an upper end of a tree. The subsea test tree has a production passage and a port that is in communication with an annulus passage in the horizontal tree.

An internal tree cap is located within the tree. A production passage passes through the internal tree cap, and an annulus passage communicates with the annulus passage of the tree.

A shuttle valve is located within a valve receptacle or valve cylinder in an upper end of the annulus passage. The valve cylinder is in communication with an upper surface of the internal tree cap. A portion of the shuttle valve extends above the upper surface of the internal tree cap so that the shuttle valve opens when the subsea test tree or riser connector lands on the top of the internal tree cap. A spring or other suitable device biases the shuttle valve upwards, or in a closed position. Alternatively, the shuttle valve may be hydraulically actuated.

DETAILED DESCRIPTION OF THE INVENTION

Figure 1:
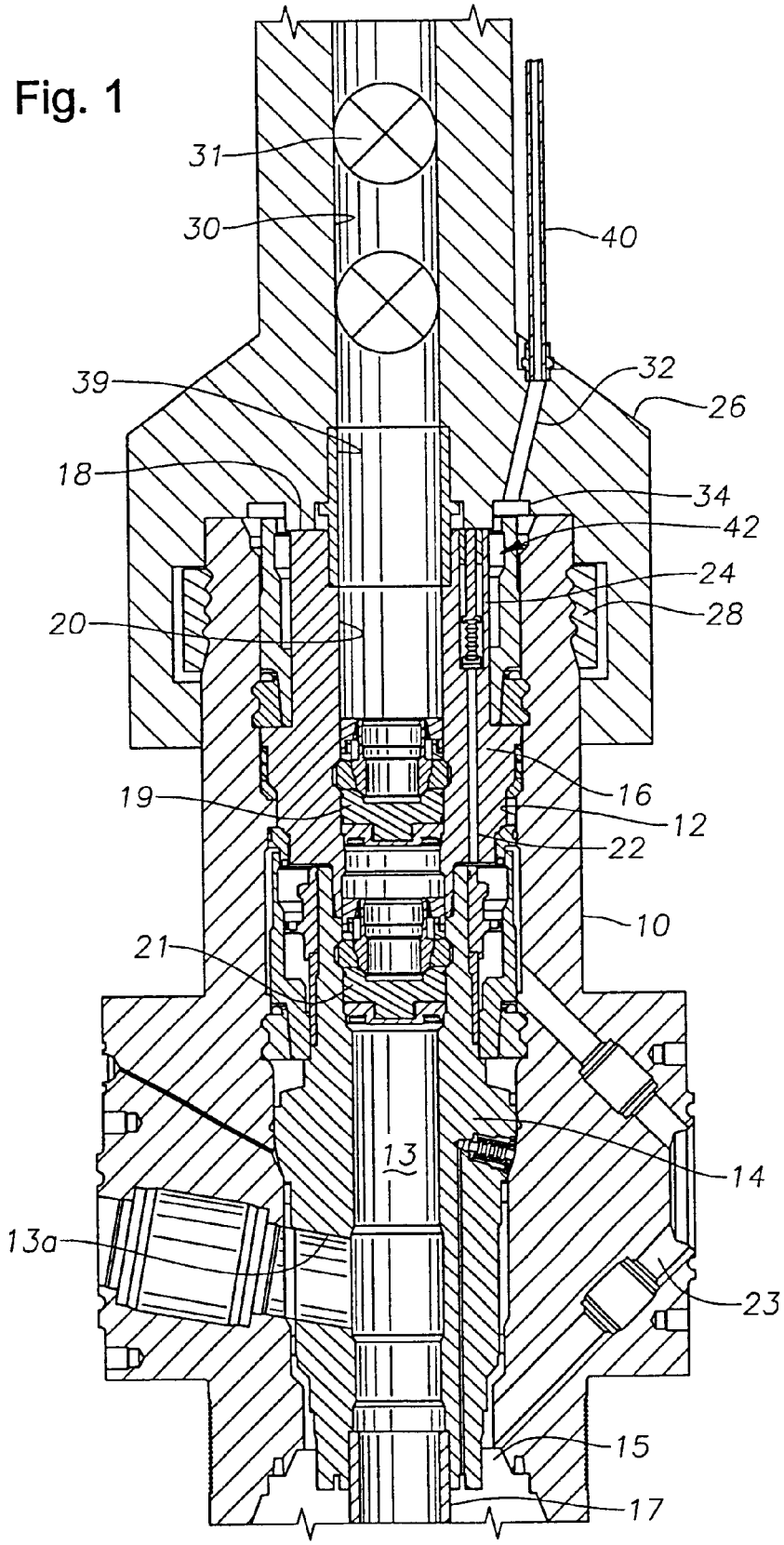
FIG. 1 is an elevational cross-sectional view of a subsea tree having an internal tree cap positioned within a horizontal tree and a subsea test tree/intervention safety valve system in accordance with this invention affixed thereto.
Figure 3:
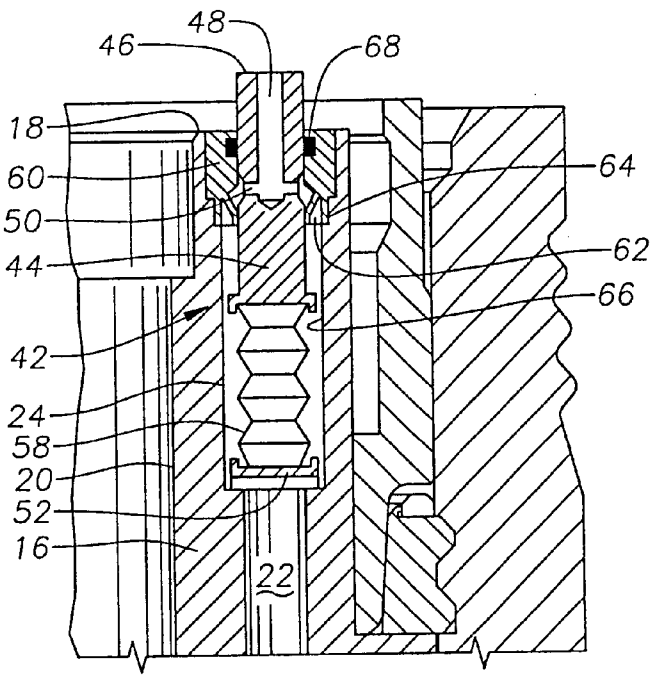
FIG. 3 is the shuttle valve member of FIG. 2 shown in an upper or closed position.
Figure 2:
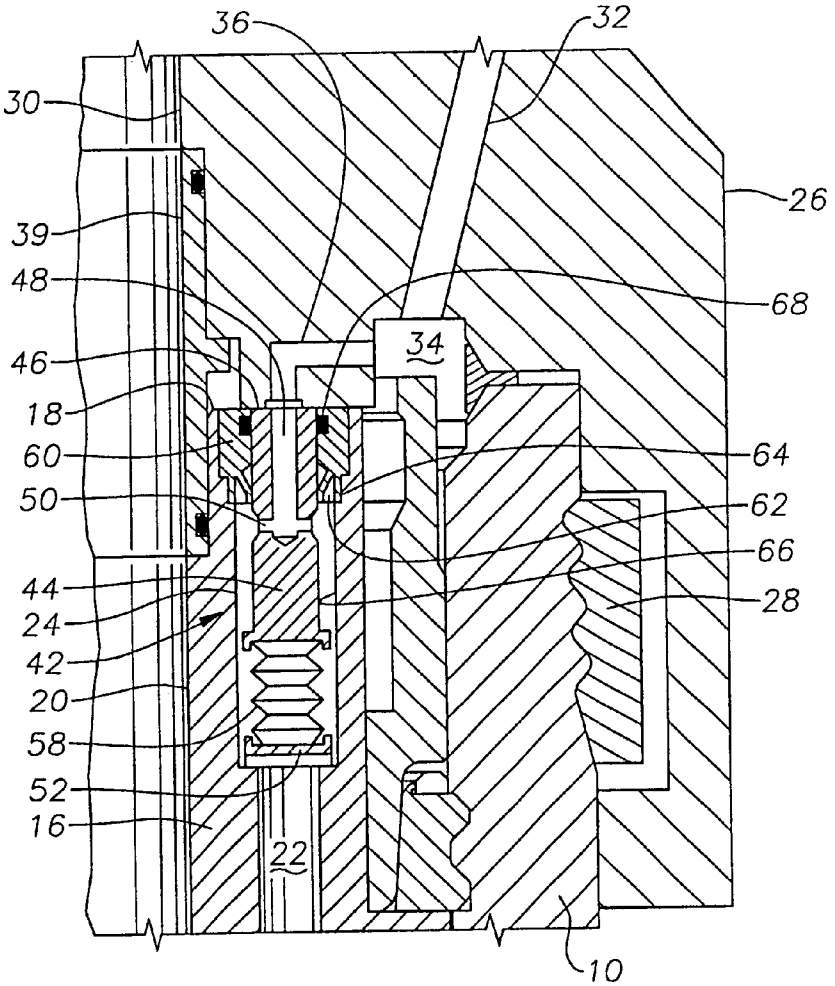
FIG. 2 is an enlarged cross-sectional view of the subsea tree of FIG. 1, showing a shuttle valve in a lower or open position. The shuttle valve in this embodiment is located in the internal tree cap and communicates with a passage in the subsea test tree.

Referring now to FIGS. 1–3, a subsea tree of a type referred to as a "horizontal" tree is designated generally 10. Subsea tree 10 has a bore 12. A tubing hanger 14 secured to a string of tubing 17 sealingly lands within bore 12. A tubing annulus 15 is formed around tubing 17. An internal tree cap 16 is positioned within bore 12 of subsea tree 10 above tubing hanger 14. Internal tree cap 16 has a top surface 18 and a production passage 20 that passes through internal tree cap 16. A first wireline retrievable plug 19 and a second wireline retrievable plug 21 are positioned within the production passage 20 of the internal tree cap 16 (FIG. 1) and tubing hanger production passage 13, respectively.

Internal tree cap 16 also has a vertical annulus passage 22 that communicates with tubing annulus 15 via annulus passages 23. Annulus passage 22 leads through internal tree cap 16 to top surface 18 of internal tree cap 16. Annulus passage 22 of internal tree cap 16 is expanded to form a valve receptacle or valve receiving cylinder 24 at an upper end of annulus passage 22.

A lightweight monobore riser having a subsea test tree (SSTT) 26 or other safety valve system on its lower end is shown connected to an upper end of subsea tree 10. Locking dogs 28 are used to secure SSTT 26 to exterior grooves on tree 10. SSTT 26 has a central passage 30 that communicates production passage 20 with the monobore passage in the riser. SSTT 26 has a pair of valves 31 that may be remotely actuated from the workover or drilling vessel to open and close central passage 30. An annulus port 32 is formed in SSTT 26 offset from central passage 30. Port 32 communicates with annular chamber 34 that is found between SSTT 26 and top surface 18 of internal tree cap 16. Port 32 leads to an exterior portion of SSTT 26. Annular chamber 34 communicates with an interior passage 36 (FIG. 2) that is in communication with valve receiving cylinder 24 formed in the annular passage 22 of the internal tree cap 16. The lower end of interior passage 36 is annular to avoid having to orient SSTT 26 with internal tree cap 16.

Sleeve 39 is positioned at the interface of production passage 30 of subsea test tree 26 and an upper end of production passage 20 of internal tree cap 16. Sleeve 39 bridges between the subsea test tree 26 and the internal tree cap 16 in lieu of a slick joint. An annulus circulation line 40

(FIG. 1) communicates with port 32 and a floating platform on a surface level of the ocean. Annulus circulation line 40 extends alongside the monobore riser and may be coiled tubing, flexible hose or integral with the controls umbilical.

A shuttle valve 42 is provided within valve receiving cylinder 24 of annulus passage 22. Shuttle valve 42 is seen more clearly in FIGS. 2 and 3. Shuttle valve 42 opens when SSTT 26 lands on a top surface 18 of internal tree cap 16.

In a first embodiment, (FIGS. 1–3) shuttle valve 42 includes a shuttle valve member 44. Shuttle valve member 44 has a top surface 46 and a vertical passage 48 that extends downward within shuttle valve member 44. Shuttle valve member 44 additionally has a horizontal passage 50 that passes through shuttle valve member 44 and communicates with the vertical passage 48. A bridge member 52 is located at a lower end of valve receiving cylinder 24. Bridge member 52 allows fluid to pass by.

A biasing means, such as a Belleville spring stack 58, is provided between a lower end of shuttle valve member 44 and bridge member 52. Belleville spring stack 58 is provided to close the shuttle valve member 44 by forcing shuttle valve member 44 upwards to a closed position. A metal lip seal 60 surrounds shuttle valve member 44. Metal lip seal 60 has an annular inner leg 62 for sealingly engaging shuttle valve member 44 and an annular outer leg 64 for sealingly engaging a wall 66 of valve receiving cylinder 24. Metal lip seal 60 additionally has a backup seal 68 that engages shuttle valve member 44. Metal lip seal 60 covers horizontal passage 50 of shuttle valve member 44 when shuttle valve member 44 is in an upper position (FIG. 3), thereby preventing fluids from traveling from annulus passage 22 into port 32. When shuttle valve member 44 is in a lower position (FIG. 2), horizontal passage 50 redirects fluids traveling upwards in annulus passageway 22 through shuttle valve member 44, and upwards to port 32.

In use, SSTT 26 may be used to perform workover operations on a previously drilled well having a subsea tree 10 as shown. A corrosion cap (not shown) will first be removed from the upper end of subsea tree 10 and SSTT 26 lowered on subsea tree 10. When SSTT 26 is lowered on a riser onto subsea tree 10, locking dogs 28 are manipulated to lock SSTT 26 and in subsea tree 10 together. A lower surface of SSTT 26 engages a top surface 46 of shuttle valve 42 as shown in FIG. 2. Before SSTT 26 is positioned on horizontal subsea tree 10, Belleville spring stack 58 biases shuttle valve 42 so that shuttle valve 42 extends above an upper surface of internal tree cap 16, as shown in FIG. 3. When the SSTT 26 is positioned on the subsea tree 10 and internal tree cap 16, a lower surface of SSTT 26 pushes shuttle valve member 44 of shuttle valve 42 downward from an upper closed position (FIG. 3) to a lower opened position (FIG. 2).

When the shuttle valve member 44 of shuttle valve 42 is in an upper closed position, fluid passing through annular passage 22 passes by bridge member 52 and around Belleville spring stack 58. The fluid is then prevented from passing by shuttle valve 42 by inner leg 62 and outer leg 64 of metal lip seal 60. When shuttle valve member 44 is in an upper position, horizontal passage 50 is not in communication with annulus passage 22, but is instead positioned above metal lip seal 60.

When the shuttle valve member 44 is forced to a lower or opened position by a lower surface of SSTT 26, then horizontal passage 50 is pushed below the inner leg 62 of metal lip seal 60 as shown in FIG. 2. Therefore, fluid passing through annulus passage 22 is able to pass by bridge member 52, past Belleville spring stack 58, into horizontal passage 50 and up through vertical passage 48 of shuttle valve member 44. The fluid may then pass through interior passage 36, into annular chamber 34, up port 32 and may pass onward through the annulus circulation line 40.

Workover operations may be performed by retrieving plugs 19, 21 on wireline or coiled tubing. Tools may be lowered through the monobore riser and SSTT 26 into tubing 17 for performing various operations. Fluid may be circulated down the riser and out a sliding sleeve or other part at the lower end of tubing 17 into the tubing annulus 15. This fluid may be returned up passage 22 and coiled tubing 40.

Figure 5:
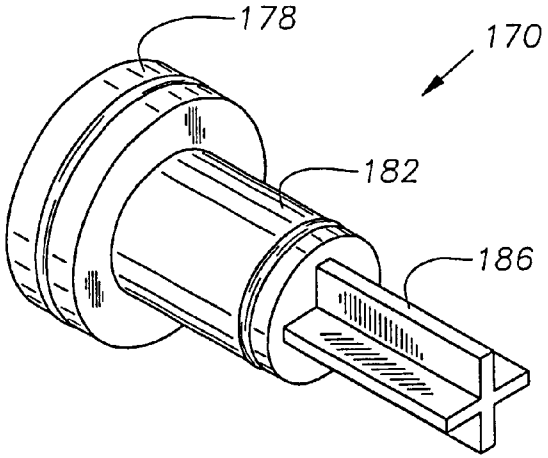
FIG. 5 is a perspective view of the hydraulic piston shown in the hydraulic shuttle valve of FIG. 4.
Figure 4:
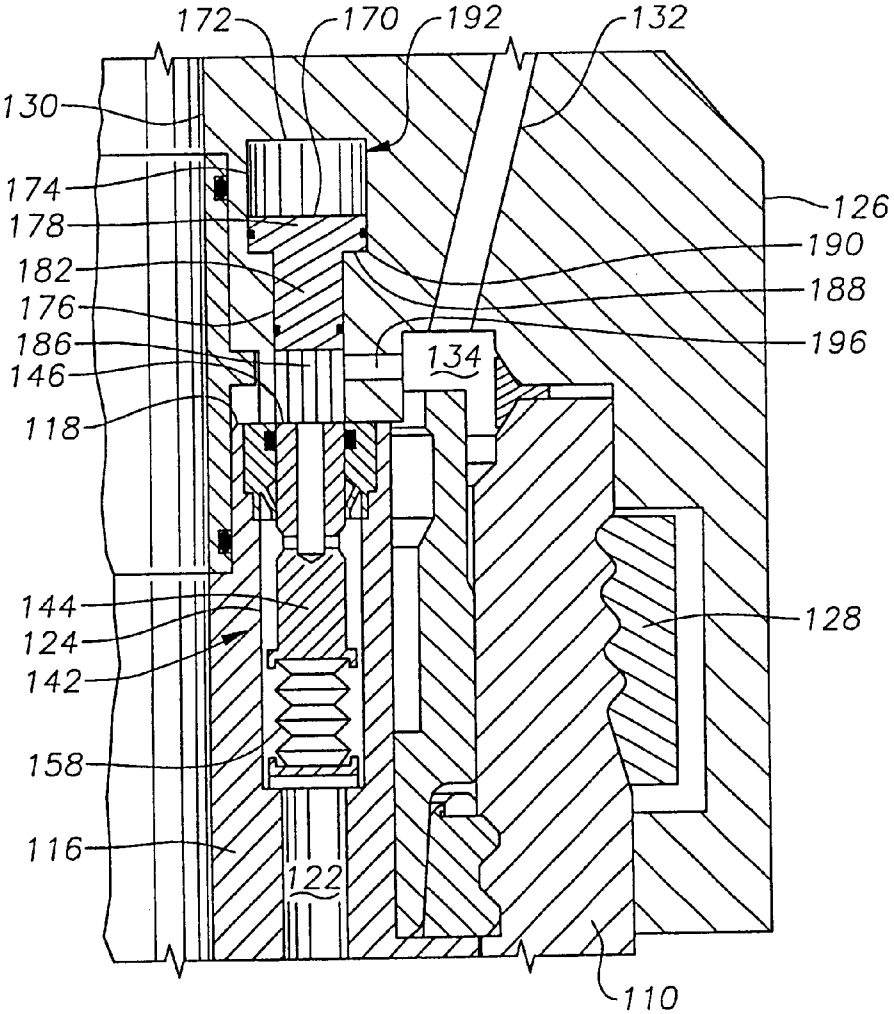
FIG. 4 is an enlarged view showing an alternate embodiment of the shuttle valve of FIGS. 1–3. The alternate embodiment is a hydraulically operated shuttle valve.

A second embodiment of the shuttle valve is a hydraulically operated shuttle valve 142, shown in FIG. 4. Referring now to FIGS. 4 and 5, an internal tree cap 116 is landed within a subsea tree 110. Internal tree cap 116 has a top surface 118 and a production passage 120 that passes through internal tree cap 116. Internal tree cap 116 also has an annulus passage 122 that communicates with a tubing annulus and with top surface 118 of internal tree cap 116. Annulus passage 122 of internal tree cap 116 is expanded to form a valve receiving cylinder 124 at an upper end of annulus passage 122.

A subsea test tree (SSTT) 126 on a lower end of a monobore riser is in affixed on an upper end of subsea tree 110. Locking dogs 128 are used to secure SSTT 126 to tree 110. SSTT 126 has a central passage 130 and an annular port 132. Port 132 communicates with an annular chamber 134 that is near top surface 118 of internal tree cap 116. Port 132 communicates with an exterior of SSTT 126.

A shuttle valve 142 constructed in the same manner as shuttle valve 42 of the first embodiment is provided within valve receiving cylinder 124 of annulus passage 122. Hydraulically operated shuttle valve 142 includes a shuttle valve member 144. A Belleville spring stack 158 biases shuttle valve 142 to an upper closed position, as in the first embodiment.

To move shuttle valve member 144 from an upper closed position to a lower opened position, a hydraulic piston 170 (FIGS. 4 and 5) is used. A piston chamber 172 is formed in SSTT 126. Piston chamber 172 has a large diameter area 174 above a small diameter area 176. Small diameter area 176 communicates with a lower surface of SSTT 126. Hydraulic piston 170 (FIGS. 4 and 5) has a head 178, a stem 182 and an extension 186. Hydraulic piston 170 is sealingly received within piston chamber 172. Head 178 is sealingly received within the area of large diameter 174. Stem 182 and extension 186 are received within the area of small diameter 176. Extension 186 is provided with a shape that allows a flow of fluid to pass around extension 186 within the small diameter area 176. An example of a suitable shape of extension 186 is a cross-shape, which is shown in FIG. 5, although other shapes may be used.

A hydraulic passage 188 is provided on a lower surface 190 of large diameter area 174 for delivering hydraulic fluid to force piston head 178 upwards. A hydraulic passage 192 near upper surface of large diameter area 174 is provided for delivering hydraulic fluid to force piston head 174 downwards. An interior passage 196 within SSTT 126 communicates with port 132 and with small diameter area 176 of piston chamber 172.

In practice, when it is desired to allow fluids to pass from the well annulus through port 132 and onward to the surface, hydraulic fluid is forced through hydraulic passage 192 into piston chamber 172 of SSTT 126. The fluid forces hydraulic piston 170 downward. Extension 186 formed on a lower end of hydraulic piston 170 engages top surface 146 of shuttle valve member 144. Extension 186 pushes shuttle valve member 144 downwards, which compresses Belleville spring stack 158 and opens valve 142. As a result, fluid in annulus passage 122 is free to pass by through gaps in extension 186, through interior passage 196, into annular chamber 134 and out port 132.

When it is desired to prevent fluids from the well annulus from traveling upwards to the surface, shuttle valve 142 is closed in the following manner. Hydraulic fluid is forced into hydraulic passage 188. The hydraulic fluid forces piston 170 upwards. The Belleville spring stack 158 moves shuttle valve member 144 upwards to the closed position above. Fluid within annulus passage 122 is then unable to pass upwards beyond hydraulically operated shuttle valve 142.

The invention of the apparatus has numerous advantages. Tubing annulus access is provided using a monobore riser. The apparatus only intermittently exposes the seal leg or upper end of the shuttle valve member. The seals of the shuttle are engaged, i.e., fully open or fully closed, a great majority of the time. Additionally, the seal leg or shuttle valve member incorporates an inherently efficient wiping action against the metal lip seal. Additionally, by placing the shuttle valve at the location of the invention, critical dimensions are not as necessary as in previous designs, i.e., the shuttle valve is isolated from the production bore and the annulus bore. The apparatus of the invention is equally applicable to conventional tree applications and horizontal trees.

An additional feature of the second embodiment is the ability to verify the pressure integrity of the device before retrieval of the SSTT (or other safety valve system) for enhanced safety in comparison with simpler devices such as simple poppet check valves and sliding sleeve systems proposed in similar situations.

While the invention has been shown in only two of its forms, it should be apparent to those skilled in the art that it is not so limited, but is susceptible to various changes without departing from the scope of the invention.

What is claimed is:

1. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage offset from said axial passage of said internal tree cap and being in communication with said top surface of said internal tree cap and with said annulus passage of said tree, said annulus passage of said internal tree cap forming a valve receptacle near said top surface;

a riser assembly that lands on an upper end of said tree, said riser assembly having an axial passage in communication with said axial passages of said tree and internal tree cap and a tubing annulus port, said port being offset from said axial passage of said internal tree cap and being in communication with said annulus passage in said internal tree cap; and a shuttle valve within said valve receptacle that moves between open and closed positions to open and close said annulus passage in said internal tree cap.

2. The apparatus according to claim 1 wherein said shuttle valve comprises a shuttle valve member that moves upward in the receptacle while moving to the closed position.

3. The apparatus according to claim 1 wherein:

said port is in communication with an annular chamber in between said riser assembly and said internal tree cap, so that said port communicates with said annular chamber at any rotational orientation of said riser assembly with respect to said internal tree cap, said annular chamber being in communication with said valve receptacle.

4. The apparatus according to claim 1 wherein:

said shuttle valve has sealing areas located entirely below said top of said internal tree cap while in said open and closed position.

5. The apparatus according to claim 1 wherein:

said shuttle valve is biased to said closed position and is moved to said open position by contact of said riser assembly while landing said riser assembly on said tree.

6. The apparatus according to claim 1:

wherein said riser assembly includes an annulus circulation line in communication with said port and a surface level.

7. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage in communication with said top surface of said internal tree cap and with said annulus passage of said tree, said annulus passage of said internal tree cap forming a valve receptacle near said top surface;

a riser assembly that lands on an upper end of said tree, said riser assembly having an axial passage in communication with said axial passages of said tree and internal tree cap and a tubing annulus port, said port being in communication with said annulus passage in said internal tree cap;

a shuttle valve within said valve receptacle that moves between open and closed positions to open and close said annulus passage in said internal tree cap; and wherein said shuttle valve comprises:

a shuttle valve member having a top surface and an axial passage extending to the top surface, said shuttle valve member extending downward within said valve receptacle, said shuttle valve member having a lateral passage that passes through said shuttle valve member, and joins said axial passage of said shuttle valve member wherein said lateral passage is obstructed by said valve receptacle when said shuttle valve member is in an upper position, closing said axial passage of said shuttle valve member, and said lateral passage is unobstructed when said shuttle valve member is in a lower position.

8. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage in communication with said top surface of said internal tree cap and with said annulus passage of said tree, said annulus passage of said internal tree cap forming a valve receptacle near said top surface;

a riser assembly that lands on an upper end of said tree, said riser assembly having an axial passage in communication with said axial passages of said tree and internal tree cap and a tubing annulus port, said port being in communication with said annulus passage in said internal tree cap;

a shuttle valve within said valve receptacle that moves between open and closed positions to open and close said annulus passage in said internal tree cap; and wherein said shuttle valve comprises:

a shuttle valve member;

an axial passage in said shuttle valve member, having a lateral port at a lower end of said axial passage of said shuttle valve member;

an annular seal in said valve receptacle; wherein said lateral port locates above said seal while said shuttle valve member is in the closed position and below said port while said shuttle valve member is in said open position.

9. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage in communication with said top surface of said internal tree cap and with said annulus passage of said tree, said annulus passage of said internal tree cap forming a valve receptacle near said top surface;

a riser assembly that lands on an upper end of said tree, said riser assembly having an axial passage in communication with said axial passages of said tree and internal tree cap and a tubing annulus port, said port being in communication with said annulus passage in said internal tree cap;

a shuttle valve within said valve receptacle that moves between open and closed positions to open and close said annulus passage in said internal tree cap; and wherein said shuttle valve comprises:

a shuttle valve member having an axial passage with a lower port and an upper port;

a lip seal in said receptacle, said lip seal having an inner leg for engaging said shuttle valve member wherein said lower port locates above said lip seal while said shuttle valve member is in the closed position and below said port while said shuttle valve member is in said open position.

10. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage in communication with said top surface of said internal tree cap and with said annulus passage of said tree, said annulus passage of said internal tree cap forming a valve receptacle near said top surface;

a riser assembly that lands on an upper end of said tree, said riser assembly having an axial passage in communication with said axial passages of said tree and internal tree cap and a tubing annulus port, said port being in communication with said annulus passage in said internal tree cap;

a shuttle valve within said valve receptacle that moves between open and closed positions to open and close said annulus passage in said internal tree cap; and a sleeve in a lower end of said axial passage of said riser assembly and in an upper end of said axial passage of said internal tree cap, said sleeve bridging between said riser assembly and said internal tree cap.

11. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage in communication with said top surface of said internal tree cap and with said annulus passage of said tree, said annulus passage of said internal tree cap forming a valve receptacle near said top surface;

a riser assembly that lands on an upper end of said tree, said riser assembly having an axial passage in communication with said axial passages of said tree and internal tree cap and a tubing annulus port, said port being in communication with said annulus passage in said internal tree cap;

a shuttle valve within said valve receptacle that moves between open and closed positions to open and close said annulus passage in said internal tree cap; and wherein said shuttle valve is hydraulically actuated between said open and closed positions.

12. The apparatus according to claim 11 further comprising:

a piston chamber in a lower end of said riser assembly;

a piston having a head and a stem, said piston received within said piston chamber and said stem contacts said shuttle valve to move it between the open and closed positions in response to hydraulic fluid pressure supplied to said piston chamber.

13. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage in communication with said top surface of said internal tree cap and with said annulus passage of said tree, said annulus passage of said internal tree cap forming a valve receptacle near said top surface and radially offset from said axial passage of said internal tree cap;

a riser assembly that lands on an upper end of said tree, said riser assembly having an axial passage in communication with said axial passages of said tree and internal tree cap and a tubing annulus port, said port being radially offset from said axial passage of said internal tree cap and being in communication with said annulus passage in said internal tree cap, and wherein said riser assembly includes an annulus circulation line in communication with said port and a surface level; and a shuttle valve installed within said valve receptacle, said shuttle valve moving between open and closed positions to open and close said annulus passage in said internal tree cap and wherein said shuttle valve has sealing areas located entirely below said top of said internal tree cap while in said open and closed position.

14. The apparatus according to claim 13 wherein said shuttle valve comprises a shuttle valve member that moves upward in the receptacle while moving to the closed position.

15. The apparatus according to claim 13 wherein:

said port is in communication with an annular chamber in between said riser assembly and said internal tree cap, so that said port communicates with said annular chamber at any rotational orientation of said riser assembly with respect to said internal tree cap, said annular chamber being in communication with said valve receptacle.

16. The apparatus according to claim 13 wherein:

said shuttle valve is biased to said closed position and is moved to said open position by contact of said riser while landing said riser assembly on said tree.

17. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage in communication with said top surface of said internal tree cap and with said annulus passage of said tree, said annulus passage of said internal tree cap forming a valve receptacle near said top surface;

a riser assembly that lands on an upper end of said tree, said riser assembly having an axial passage in communication with said axial passages of said tree and internal tree cap and a tubing annulus port, said port being in communication with said annulus passage in said internal tree cap, and wherein said riser assembly includes an annulus circulation line in communication with said port and a surface level;

a shuttle valve within said valve receptacle that moves between open and closed positions to open and close said annulus passage in said internal tree cap and wherein said shuttle valve has sealing areas located entirely below said top of said internal tree cap while in said open and closed position; and wherein said shuttle valve comprises:

a shuttle valve member having a top surface and an axial passage extending to the top surface, said shuttle valve member extending downward within said valve receptacle, said shuttle valve member having a lateral passage that passes through said shuttle valve member, and joins said axial passage of said shuttle valve member wherein said lateral passage is obstructed by said valve receptacle when said shuttle valve member is in an upper position, closing said axial passage of said shuttle valve member, and said lateral passage is unobstructed when said shuttle valve member is in a lower position.

18. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage in communication with said top surface of said internal tree cap and with said annulus passage of said tree, said annulus passage of said internal tree cap forming a valve receptacle near said top surface;

a riser assembly that lands on an upper end of said tree, said riser assembly having an axial passage in communication with said axial passages of said tree and internal tree cap and a tubing annulus port, said port being in communication with said annulus passage in said internal tree cap, and wherein said riser assembly includes an annulus circulation line in communication with said port and a surface level;

a shuttle valve within said valve receptacle that moves between open and closed positions to open and close said annulus passage in said internal tree cap and wherein said shuttle valve has sealing areas located entirely below said top of said internal tree cap while in said open and closed position; and wherein said shuttle valve comprises:

a shuttle valve member;

an axial passage in said shuttle valve member, having a lateral port at a lower end of said axial passage of said shuttle valve member;

an annular seal in said valve receptacle; wherein said lateral port locates above said seal while said shuttle valve member is in the closed position and below said port while said shuttle valve member is in said open position.

19. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage in communication with said top surface of said internal tree cap and with said annulus passage of said tree, said annulus passage of said internal tree cap forming a valve receptacle near said top surface;

a riser assembly that lands on an upper end of said tree, said riser assembly having an axial passage in communication with said axial passages of said tree and internal tree cap and a tubing annulus port, said port being in communication with said annulus passage in said internal tree cap, and wherein said riser assembly includes an annulus circulation line in communication with said port and a surface level;

a shuttle valve within said valve receptacle that moves between open and closed positions to open and close said annulus passage in said internal tree cap and wherein said shuttle valve has sealing areas located entirely below said top of said internal tree cap while in said open and closed position; and wherein said shuttle valve comprises:

a shuttle valve member having an axial passage with a lower port and an upper port;

a lip seal in said receptacle, said lip seal having an inner leg for engaging said shuttle valve member wherein said lower port locates above said lip seal while said shuttle valve member is in the closed position and below said port while said shuttle valve member is in said open position.

20. A subsea well apparatus comprising:

a tree having an axis, an axial passage registering with a string of production tubing and a tubing annulus passage;

an internal tree cap within said tree, said internal tree cap having a top surface, an axial passage passing therethrough in communication with said axial passage of said tree, and a tubing annulus passage in communication with said top surface of said internal tree cap and with said annulus passage of said tree, said annulus passage of said internal tree cap forming a valve receptacle near said top surface;

a riser assembly that lands on an upper end of said tree, said riser assembly having an axial passage in communication with said axial passages of said tree and internal tree cap and a tubing annulus port, said port being in communication with said annulus passage in said internal tree cap, and wherein said riser assembly includes an annulus circulation line in communication with said port and a surface level;

a shuttle valve within said valve receptacle that moves between open and closed positions to open and close said annulus passage in said internal tree cap and wherein said shuttle valve has sealing areas located entirely below said top of said internal tree cap while in said open and closed position; and a sleeve in a lower end of said axial passage of said riser and in an upper end of said axial passage of said internal tree cap, said sleeve bridging between said riser assembly and said internal tree cap.

21. A method of connecting a subsea tree to a surface vessel for a workover operation, said tree having an axial passage registering with a string of production tubing and a tubing annulus passage, the method comprising:

installing an internal tree cap within said tree, said internal tree cap having an axial passage and a valve receptacle offset from said axial passage of said internal tree cap in communication with said tubing annulus passage and a shuttle valve that opens and closes said annulus passage; then lowering a riser from the vessel and landing the riser on an upper end of said tree, said riser having an axial passage and a port offset from said axial passage of said internal tree cap said port being in communication with said valve receptacle in said internal tree cap and being connected to an annulus access line incorporated with said riser and leading to said vessel; and opening said shuttle valve to communicate said tubing annulus passage with said annulus access line.

22. The method according to claim 21 wherein said shuttle valve is open when a shuttle valve member is in a lower position and is closed when said shuttle valve member is in an upper position.

23. The method according to claim 21 wherein a portion of said riser contacts said shuttle valve while landing on said tree and moves said shuttle valve downward to an open position.

24. A method of connecting a subsea tree to a surface vessel for a workover operation, said tree having an axial passage registering with a string of production tubing and a tubing annulus passage, the method comprising:

installing an internal tree cap within said tree, said internal tree cap having a valve receptacle in communication with said tubing annulus passage and a shuttle valve that opens and closes said annulus passage;

lowering a riser from the vessel and landing the riser on an upper end of said tree, said riser having an axial passage and a port, said port being in communication with said valve receptacle in said internal tree cap and being connected to an annulus access line incorporated with said riser and leading to said vessel; and opening said shuttle valve to communicate said tubing annulus passage with said annulus access line by hydraulically actuating said shuttle valve to open by supplying hydraulic fluid pressure from said riser.

* * * * *